US006468106B2

(12) United States Patent
Durocher

(10) Patent No.: US 6,468,106 B2
(45) Date of Patent: Oct. 22, 2002

(54) FRET ASSEMBLY

(75) Inventor: Daniel J. Durocher, Leonard, MI (US)

(73) Assignee: TRW Inc., Lyndhurst, OH (US)

( * ) Notice: Subject to any disclaimer, the term of this patent is extended or adjusted under 35 U.S.C. 154(b) by 0 days.

(21) Appl. No.: 09/772,162

(22) Filed: Jan. 29, 2001

(65) Prior Publication Data

US 2002/0102875 A1 Aug. 1, 2002

(51) Int. Cl.[7] ..... H01R 12/24
(52) U.S. Cl. ..... 439/493; 439/67
(58) Field of Search ..... 439/67, 493, 77, 439/876, 499

(56) References Cited

U.S. PATENT DOCUMENTS 4,526,432 A * 7/1985 Cronin et al. ..... 339/75 M
5,057,023 A * 10/1991 Kabadi et al. ..... 439/67
5,306,162 A * 4/1994 Armendariz ..... 439/67
5,730,619 A * 3/1998 Hamlin ..... 439/493
5,873,739 A * 2/1999 Roberts ..... 439/67
6,045,396 A * 4/2000 Tighe ..... 439/493

* cited by examiner

*Primary Examiner*—Gary F. Paumen
*Assistant Examiner*—Ann McCamey
(74) *Attorney, Agent, or Firm*—Tarolli, Sundheim, Covell, Tummino & Szabo L.L.P.

(57) ABSTRACT

An apparatus (10) includes a base (20) and a plurality of electrically conductive frets (14) connected to the base. The frets (14) have exposed portions (82) on a first surface (40) of the base (20). The apparatus (10) further includes a cover (22) and a pad (80) that is connected with a second surface (62) of the cover (22). The cover (22) is connected with the base (20) such that the second surface (62) of the cover overlies the first surface (40) of the base and the pad (80) overlies the exposed portions (82) of the frets (14). The pad (80) is compressed between the frets (14) and the cover (22).

15 Claims, 3 Drawing Sheets

FRET ASSEMBLY

FIELD OF THE INVENTION

The present invention relates to electrical connectors. In particular, the present invention relates to a fret assembly for a flat cable.

BACKGROUND OF THE INVENTION

It is known to use an electrical connector to terminate cables in order to help provide a means by which to connect and disconnect the cable. One such type of electrical connector is a fret assembly for a flat cable. A known fret assembly includes conductive frets disposed in a housing. The housing is connected to the cable such that the frets are placed in electrical contact with the conductors in the cable.

SUMMARY OF THE INVENTION

An apparatus comprises a base and a plurality of electrically conductive frets connected to the base. The frets have exposed portions on a first surface of the base. The apparatus further comprises a cover and a pad that is connected with a second surface of the cover. The cover is connected with the base such that the second surface of the cover overlies the first surface of the base and the pad overlies the exposed portions of the frets. The pad is compressed between the frets and the cover.

BRIEF DESCRIPTION OF THE DRAWINGS

The foregoing and other features of the present invention will become apparent to one skilled in the art to which the present invention relates upon consideration of the following description of the invention with reference to the accompanying drawings, in which.

DESCRIPTION OF AN EMBODIMENT OF THE INVENTION

Figure 1:
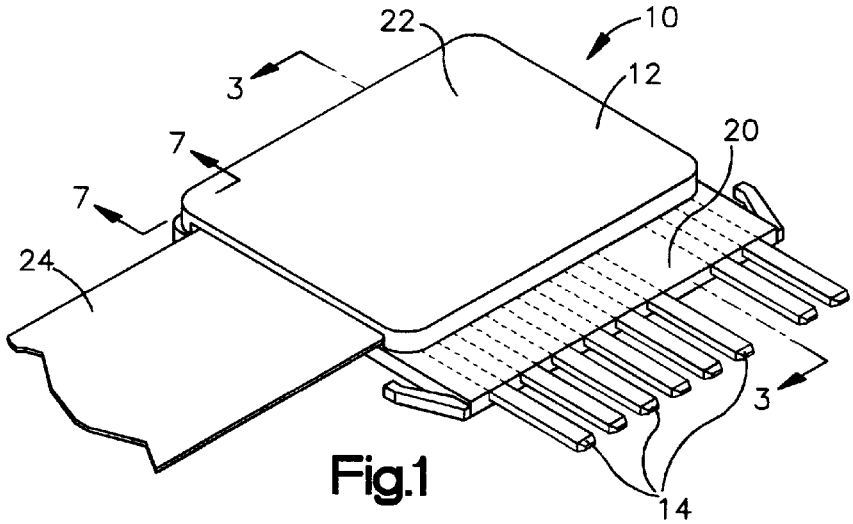
FIG. 1 is a perspective view of a fret assembly in accordance with the present invention.

As representative of an embodiment of the present invention, FIG. 1 illustrates a fret assembly 10. The fret assembly 10 comprises a housing 12 and a plurality of frets 14 connected to the housing. The housing 12 comprises a base 20 and a cover 22. The housing 12 is adapted to receive and attach to a cable 24.

Figure 2:
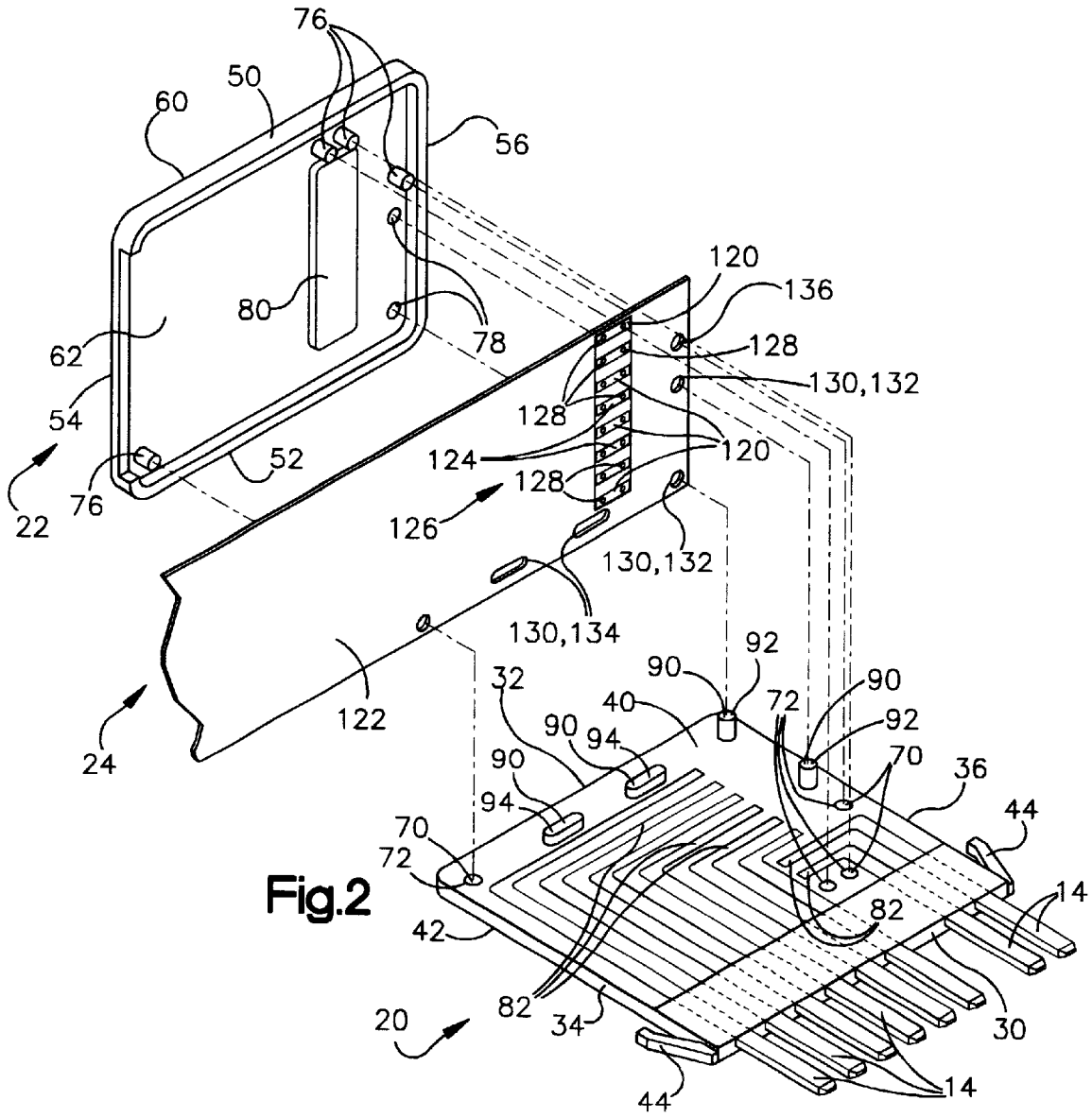
FIG. 2 is an exploded perspective view of the fret assembly of FIG. 1.
Figure 5:
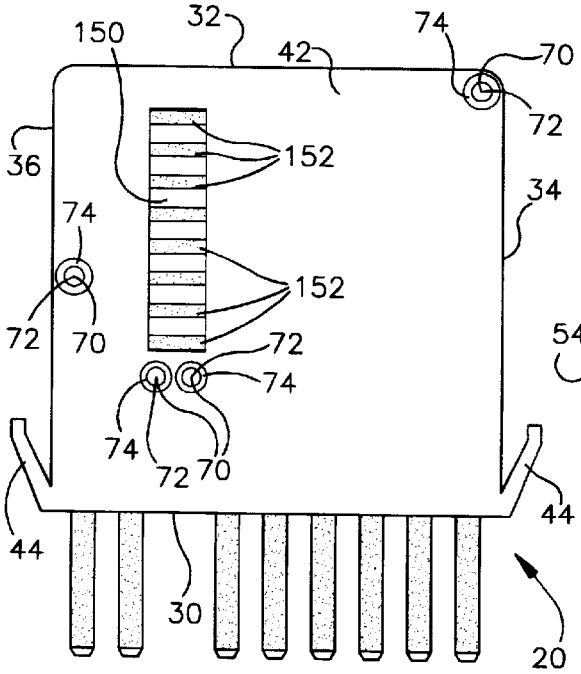
FIG. 5 is a bottom view of the portion of the fret assembly of FIG. 4.
Figure 4:
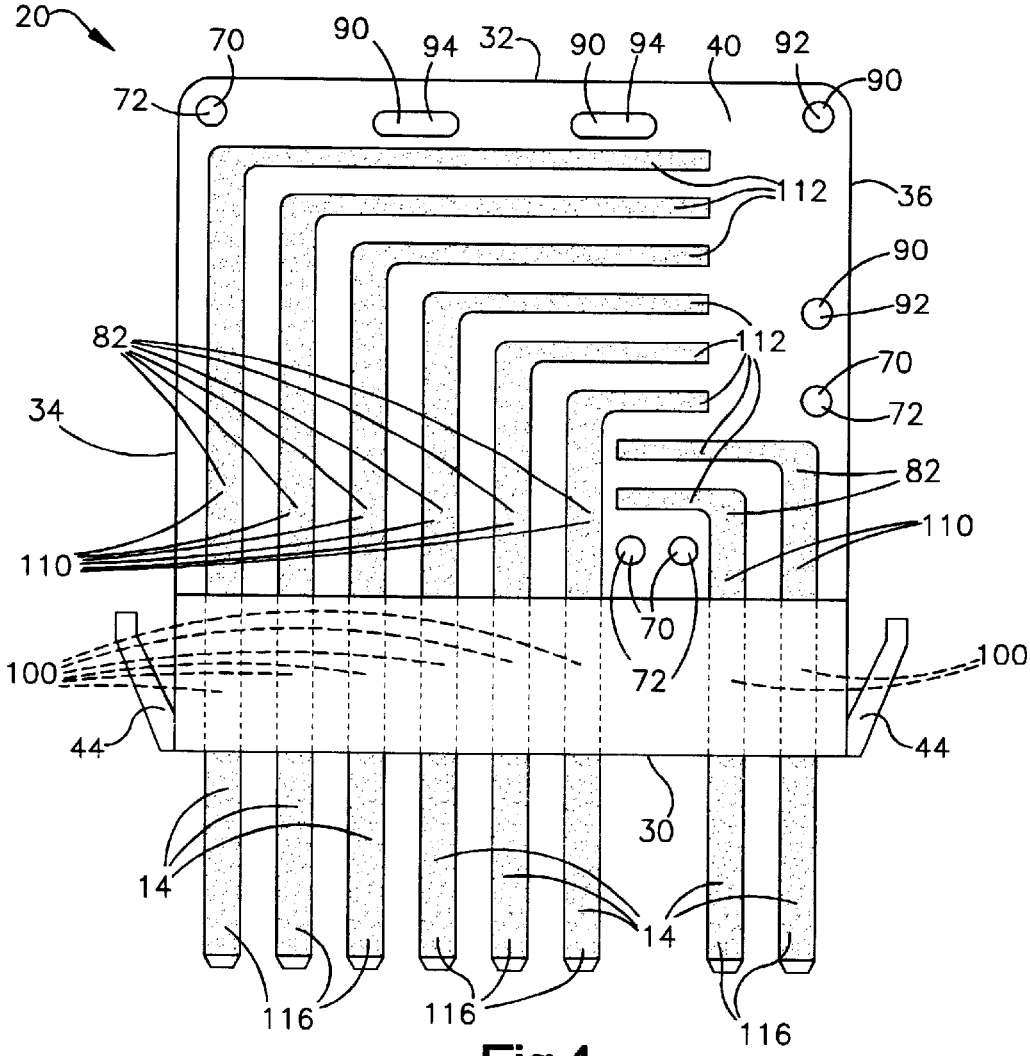
FIG. 4 is a top view of a portion of the fret assembly of FIG. 1.

Referring to FIGS. 2, 4 and 5, the base 20 has a generally rectangular shape defined by a front edge 30, an opposite rear edge 32 and first and second side edges 34 and 36, respectively, that extend between the front and rear edges. The base 20 also includes an upper surface 40 and an opposite lower surface 42. The base 20 may also include resiliently deflectable locking tabs 44. In the illustrated embodiment, one locking tab 44 is positioned adjacent the intersection of the front edge 30 and the first side edge 34 and another locking tab is positioned adjacent the front edge 30 and the second side edge 36. The locking tabs 44 are resiliently deflectable inward towards the first and second side edges 34 and 36, respectively.

Figure 6:
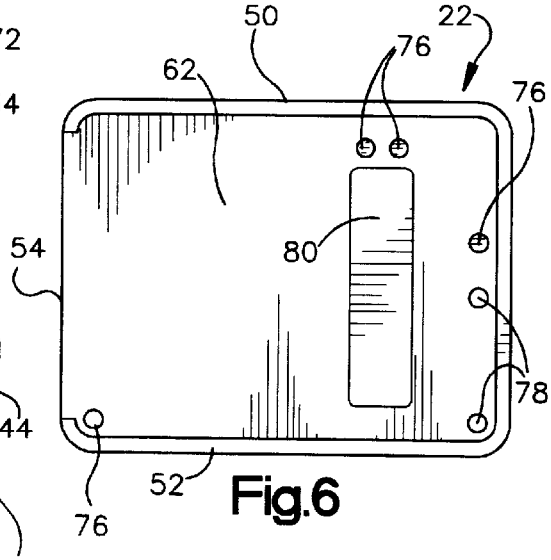
FIG. 6 is a bottom view of another portion of the fret assembly of FIG. 1.

Referring to FIGS. 2 and 6, the cover 22 has a generally rectangular shape defined by a front edge 50, an opposite rear edge 52 and first and second side edges 54 and 56, respectively, that extend between the front and rear edges. The cover 22 also includes an upper surface 60 and an opposite lower surface 62. In the illustrated embodiment, the front and rear edges 50 and 52 of the cover 22 are generally the same length as the front and rear edges 30 and 32 (FIG. 2) of the base 20, whereas the first and second side edges 54 and 56 of the cover 22 are shorter than the first and second side edges 34 and 36 of the base 20.

The base 20 (FIGS. 2, 4 and 5) includes a plurality of cylindrical sockets 70 spaced in a predetermined pattern about the upper surface 40 of the base. The sockets 70 extend through the base from the upper surface 40 to the lower surface 42. The sockets 70 have a first portion 72 of a first diameter that extends from the upper surface 40 into the base 20. As illustrated in FIG. 5, the sockets 70 have a second portion 74 of a second diameter, larger than the first diameter, that extends from the lower surface 42 into the base 20.

The base 20 (FIGS. 2 and 4) also includes a plurality of locator pins 90 that protrude from the upper surface 40 of the base in a predetermined pattern. First locator pins 92 have a generally circular cross-section and second locator pins 94 have an elongated or oval-shaped cross-section.

The cover 22 (FIGS. 2 and 6) includes a plurality of pins 76 spaced in a predetermined pattern about the lower surface 62 of the cover. The predetermined pattern of the pins 76 corresponds to the predetermined pattern of the sockets 70. The diameter of the pins 76 is about equal to the first diameter of the first portion 72 of the sockets 70. The cover 22 also includes a pair of sockets 78 that extend into the lower surface 62 of the cover. The sockets 78 are generally cylindrical and are spaced along the second side edge 56 of the cover 22 in a pattern that corresponds to the first locator pins 92.

The cover 22 further includes a rectangular pad 80 connected with the lower surface 62 of the cover. Preferably, the pad 80 is constructed of a silicone material. Such a material is preferable because it is deflectable, resilient, and able to withstand heat. Those skilled in the art, however, will recognize that the pad 80 may be constructed of alternative materials, such as plastics, that are capable of withstanding heat, but may or may not be readily deflectable and/or resilient.

Preferably, the housing 12 (FIG. 1) is constructed of a plastic material and the frets 14 are constructed of a metal, such as copper. The frets 14 may be connected to the base 20 by known means, such as by insert molding the frets in the housing, heat staking the frets to the housing, or bonding the frets to the housing with an adhesive. Those skilled in the art will recognize that other suitable materials may be used to construct the fret assembly 10. Those skilled in the art will also recognize that other suitable materials and methods may be used to connect the frets 14 to the base 20.

In the illustrated embodiment, the frets 14 are connected to the base 20 by insert molding the frets in the base 20. The frets 14 are positioned such that enclosed portions 100 (FIG. 4) of the frets are surrounded by the base 20 and exposed portions 82 of the frets 14 are exposed on the upper surface 40 of the base. The exposed portions 82 lie generally flush with the upper surface 40 (see FIG. 3*a*).

As shown in FIG. 4, the fret assembly 10 includes eight frets 14, each having a generally L-shaped configuration. The frets 14 each have a first leg 110 that extends from the front edge 30 towards the rear edge 32 of the base 20 in a direction generally parallel to the first an second side edges 34 and 36. Each of the frets 14 also has a second leg 112 that extends perpendicularly from an end of the first leg 110 opposite the front edge 30 of the base 20. A portion of each of the first legs 110 of the frets 14 forms a pin 116 that protrudes from the front edge 30 of the base 20 in a direction perpendicular to the front edge.

The second legs 112 comprise portions of the exposed portions 82 of the frets 14 and thus are exposed on the upper surface 40 of the base. In the illustrated embodiment, six of the frets 14 include second legs 112 that extend toward the second side edge 36 and two of the frets have second legs that extend towards the first side edge 34. The second legs 112 are thus spaced apart and extend parallel to each other.

The number of frets 14 included in the fret assembly 10, the pattern along which each of the frets is formed, and the arrangement and spacing of the frets on the base 20 is illustrative of only one particular embodiment of the present invention. Those skilled in the art will appreciate that the number, pattern, arrangement and spacing of the frets 14 may vary widely depending on the particular application for which the present invention is applied. Also, those skilled in the art will recognize that the housing 12 may be formed in a desired shape in order to accommodate use of the fret assembly 10 within the confines of a particular location in which use of the fret assembly is desired.

Referring to FIG. 2, the cable 24 comprises a plurality of conductors 120 surrounded by an insulating material 122. The conductors 120 are spaced from each other and extend generally parallel to each other, thus giving the cable 24 a generally flat configuration. Portions of the insulating material 122 are removed from the cable 24 to provide exposed portions 124 of the conductors 120. The exposed portions 124 of the cable 24 are arranged in a generally rectangular area 126. As illustrated in FIG. 2, solder 128 is applied to each of the exposed portions 124. The solder 128 may be in the form of a solder paste that sticks to the exposed portions 124 or may be in the form of solder that has been melted and cooled to adhere to the exposed portions 124.

The cable 24 includes a plurality of locator holes 130 that extend through the cable. First locator holes 132 have a generally circular shape that corresponds with the cross-section of the first locator pins 92. Second locator holes 134 have an elongated or oval shape that corresponds with the cross-section of the second locator pins 94. A third locator hole 136 has a circular shape that corresponds with the cross-section of the pins 76. The first and second locator holes 132 and 134 are arranged in a predetermined pattern that corresponds to the predetermined pattern of the first and second locator pins 92 and 94 on the base 20. The third locator hole 136 is located in a position that corresponds to the position of the pin 76 adjacent the second side edge 56 of the cover 22.

Figure 3:
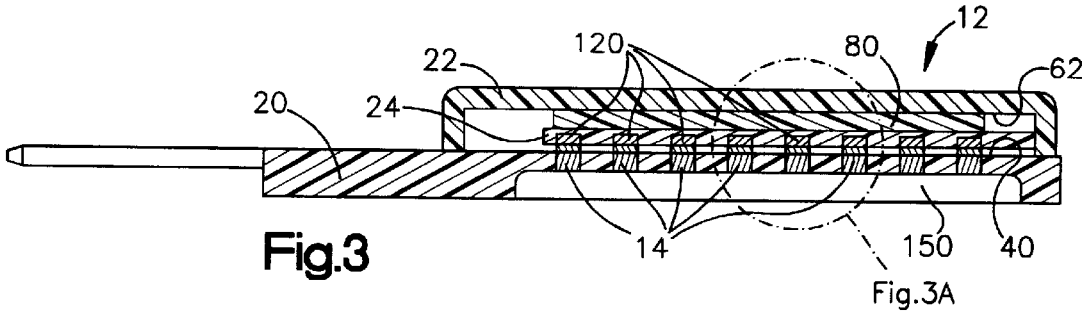
FIG. 3 is a sectional view, taken generally along line 3—3 of FIG. 1.
Figure 3A:
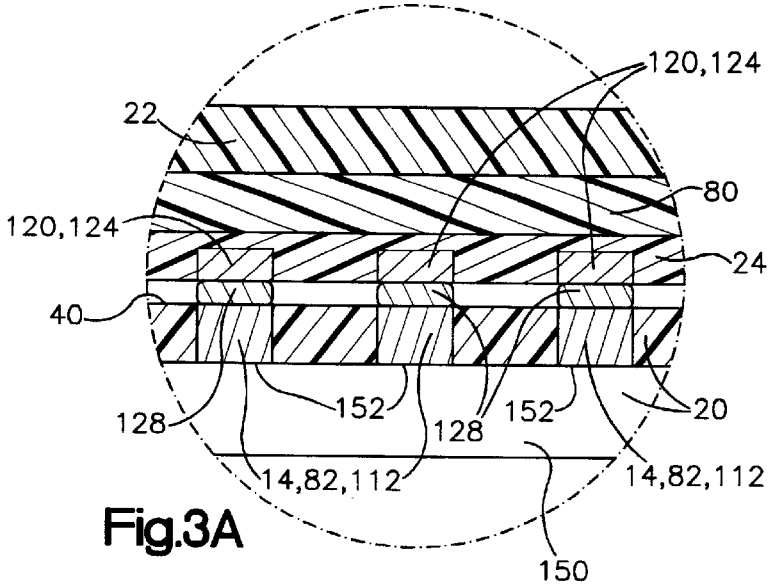
FIG. 3*a* is a magnified view of,a portion of the fret assembly of FIG. 3.

Assembly of the fret assembly 10 is indicated generally by the dashed lines in FIG. 2. To attach the cable 24 to the fret assembly 10, the cable is placed on the base 20 such that the first and second locator pins 92 and 94 extend through the first and second locator holes 132 and 134, respectively, which helps to position the cable 24 relative to the base 20. As a result, the exposed portions 124 of the conductors 120 are positioned adjacent the exposed portions 82 of the second legs 112 of the frets 14. This is shown in FIGS. 3 and 3*a*.

When the exposed portions 124 of the conductors 120 are positioned adjacent the exposed portions 82 of the frets 14, the solder 128 is disposed between the adjacent exposed portions. The width and spacing of the exposed portions 124 of the conductors 120 is equal to or about equal to the width and spacing of the exposed portions 82 of the second legs 112 of the frets 14. Thus, when the cable 24 is placed on the base 20, each of the exposed portions 124 of the conductors 120 overlies an exposed portion 114 of a single fret 14.

Those skilled in the art will recognize that it may be desirable for an exposed portion 124 of a single conductor 120 to overlie the exposed portions 114 of a plurality of frets 14. In such an instance, the exposed portion 124 of the conductor 120 may have a width large enough to overlie exposed portions 114 of a plurality of frets 14. Alternatively, a conductor 120 may extend transverse to the frets 14 so as to have exposed portions 124 that overlie exposed portions 114 of a plurality of frets 14.

It may also be desirable for exposed portions 114 of a plurality of conductors 120 to overlie the exposed portion 114 of a single fret 14. In such an instance, the exposed portion 114 of the single fret 14 may have a width large enough to overlie the exposed portions 114 of a plurality of conductors 120. Alternatively, a fret 14 may extend transverse to the conductors 120 such that exposed portions 124 of a plurality of conductors overlie the exposed portion 114 of a single fret 14.

When the cable 24 is positioned on the base 20, the housing 12 is placed in a closed condition wherein the cover 22 overlies the base 20. The closed condition is illustrated in FIG. 1. When the housing 12 is in the closed condition, the lower surface 62 (FIG. 3) of the cover is positioned facing the upper surface 40 of the base 20. The pins 76 are aligned with and extend into the sockets 70 (see FIG. 2). The first locator pins 92 extend through the cable 24 and into the sockets 78 in the cover 22 (see FIG. 2). The pins 76 and the first locator pins 92 thus help position the cover 22 relative to the base 20. Also, when the housing 12 (FIGS. 3 and 3*a*) is in the closed condition, the pad 80 is positioned adjacent the cable 24 on the side of the cable opposite the exposed portions 124 of the conductors 120. When the housing 12 is in the closed condition, the cable 24 and the pad 80 are compressed between the base 20 and the cover 22.

Figure 7A:
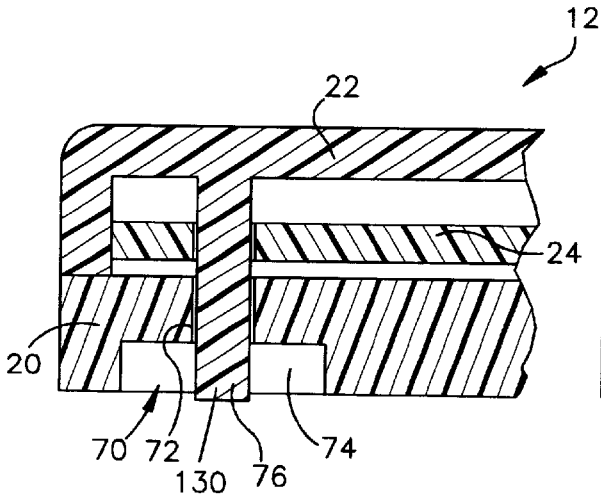
FIGS. 7*a* and 7*b* are enlarged sectional views, taken generally along line 7—7 in FIG. 1, showing parts of the fret assembly in different conditions.
Figure 7B:
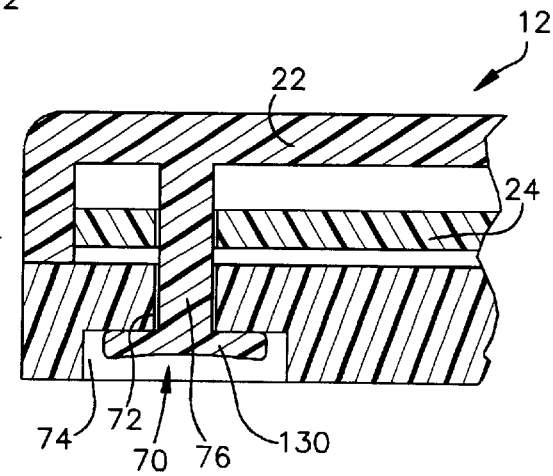

Referring to FIGS. 7*a* and 7*b*, when the housing 12 is in the closed condition, the pins 76 on the cover 22 extend through the sockets 70 in the base 20 such that a portion 130 of each pin extends into the second portion 74 of a respective socket. The portion 130 can then be melted to connect or "heat stake" the cover 22 to the base 20. In doing so, the melted portion 130 of the pin 76 decreases in length and increases in diameter to fill the larger diameter of the second portion 74 of the socket 70 (see FIG. 7*b*). This creates an interference between the melted portion 130 of the pin 76 and the first portion 72 of the socket 70, which secures the cover 22 to the base 20.

Referring to FIGS. 3 and 3*a*, when the cover 22 is connected to the base 20, the cable 24 and the pad 80 are compressed between the base and the cover. The pad 80 deflects under the compressive force applied by the base 20 and the cover 22. The pad 80 thus transmits the compressive force to the overlying exposed portions 124 of the conductors 120 and the exposed portions 82 of the second legs 112 of the frets 14. The resiliency of the material used to construct the pad 80 urges the pad to return to its original, uncompressed shape. This helps maintain the compressive force on the overlying exposed portions 124 of the conductors 120 and the exposed portions 82 of the frets 14 when the cover 22 is connected to the base 20. As a result, the base 20, cover 22 and cable 24 are held and maintained in an assembled position when the cover 22 is connected to the base 20.

While the base 20, cover 22 and cable 24 are held together in the assembled position, the solder 128 may be melted or "flowed" and then cooled in order to connect the exposed portions 124 of the conductors 120 to the exposed portions 82 of the frets 14. As illustrated in FIGS. 3, 3*a* and 5, the base 20 may include a passage 150 for providing access to surfaces 152 of the second legs 112 of the frets 14 opposite the exposed portions 82. The passage 150 allows a heat source (not shown), such as a heater bar or an induction heater, to heat the frets 14, which conduct heat to the solder 128. The solder 128 is thus melted to connect the conductors 120 to the frets 14.

Those skilled in the art will recognize that, when the solder 128 is being flowed, handling of the fret assembly 10 may tend to disturb the alignment of the base 20, cover 22, and the cable 24. Advantageously, the compressive force applied by the pad 80 helps to maintain the relative positioning of the base 20, cover 22 and cable 24. This helps to eliminate stress on the fret assembly 10 which may disrupt the relative positioning of the base 20, cover 22 and/or cable 24.

When the fret assembly 10 is in the assembled condition, the deflection of the pad 80 helps to distribute the compressive force applied to the cable 24 by the base 20 and the cover 22 generally evenly across the cable. This helps to ensure that the solder 128, when melted, is spread evenly and uniformly between the conductors 120 and the frets 14. In the case where the solder 128 comprises a solder paste, the pad 80 helps distribute the paste evenly between the conductors 120 and the frets 14 before the solder is flowed.

Once assembled, the fret assembly 10 (FIG. 1) may be plugged into a suitable receptacle (not shown), which receives the pins 16 to electrically connect conductors of the receptacle to the cable 24 via the frets 14. The locking tabs 44 cooperate with the receptacle in a known manner to maintain the fret assembly 10 connected to the receptacle. The fret assembly 10 thus supports the cable 24 for connection to the receptacle.

From the above description of the invention, those skilled in the art will perceive improvements, changes and modifications in the invention. Such improvements, changes and modifications within the skill of the art are intended to be covered by the appended claims.

Having described the invention, I claim:

1. A fret assembly connectable to a flat cable that includes a plurality of spaced apart conductors surrounded by an insulating material, the conductors including exposed portions wherein the conductors are exposed through the insulating material, said fret assembly comprising:

a base having an upper surface;

a plurality of electrically conductive frets connected to said base, said frets having exposed portions on said upper surface of said base;

a cover connectable to said base such that a lower surface of said cover overlies said upper surface of said base; and a pad connected with said lower surface of said cover;

the flat cable being receivable between said base and said cover such that the exposed portions of the conductors overlie said exposed portions of said frets and said pad overlies a surface of the flat cable opposite the exposed portions of the conductors, said fret assembly further comprising a layer of solder disposed between the exposed portions of the conductors and said exposed portions of said frets, said pad being compressed between said cover and said base when said cover is connected to said base, said pad when compressed compressing said layer of solder between the exposed portions of the conductors and said exposed portions of said frets.

2. The fret assembly recited in claim 1, wherein said pad when compressing said layer of solder between the exposed portions of the conductors and said exposed portions of said frets helping to flow said solder evenly over the exposed portions of the conductors and said exposed portions of said frets when said solder is melted.

3. The fret assembly recited in claim 1, wherein said solder comprises a solder paste, said pad when compressed between said cover and said base helping to distribute said solder paste evenly between the exposed portions of the conductors and said exposed portions of said frets.

4. The fret assembly recited in claim 1, wherein said pad is deflectable when compressing said layer of solder between the exposed portions of the conductors and said exposed portions of said frets, said pad helping to distribute said compressive force in equal amounts between the exposed portions of the conductors and said exposed portions of said frets.

5. The fret assembly recited in claim 1, wherein the conductors of the flat cable are spaced side by side in a generally flat configuration and extend parallel to each other.

6. The fret assembly recited in claim 1, wherein said exposed portions of said frets are spaced side by side in a generally flat configuration and extend parallel to each other.

7. The fret assembly recited in claim 1, wherein said layer of solder connects the conductors to said frets after said layer of solder is melted and flowed.

8. The fret assembly recited in claim 1, wherein the exposed portions of each of the conductors are compressed against a respective one of said exposed portions of said frets.

9. The fret assembly recited in claim 1, wherein each of the exposed portions of the conductors are compressed against only one of said exposed portions of said frets.

10. The fret assembly recited in claim 1, wherein said base surrounds portions of said frets.

11. The fret assembly recited in claim 1, wherein said pad is constructed of a deflectable material.

12. The fret assembly recited in claim 11, wherein said deflectable material consists essentially of a silicone material.

13. A fret assembly connectable to a flat cable that includes a plurality of spaced apart conductors surrounded by an insulating material, the conductors including exposed portions wherein the conductors are exposed through the insulating material, said fret assembly comprising:

a base having an upper surface;

a plurality of electrically conductive frets connected to said base, said frets having exposed portions on said upper surface of said base;

a cover connectable to said base such that a lower surface of said cover overlies said upper surface of said base; and a pad connected with said lower surface of said cover;

the flat cable being receivable between said base and said cover such that the exposed portions of the conductors overlie said exposed portions of said frets and said pad overlies a surface of the flat cable opposite the exposed portions of the conductors, said fret assembly further comprising a layer of solder disposed between the exposed portions of the conductors and said exposed portions of said frets, said pad being compressed between said cover and said base when said cover is connected to said base, said pad when compressed compressing said layer of solder between the exposed portions of the conductors and said exposed portions of said frets, said base including a passage on a lower surface of said base opposite said upper surface of said base, said passage exposing a surface of said frets opposite said exposed portions of said frets, said passage being adapted to receive means for applying heat to said exposed surfaces of said frets in order to melt and flow said layer of solder.

14. Apparatus comprising:

a base having an upper surface, said base including a plurality of electrically conductive frets having exposed portions on said upper surface of said base;

a cable that includes a plurality of spaced apart conductors surrounded by an insulating material, said conductors including exposed portions wherein said conductors are exposed through said insulating material, said cable being positioned on said base such that said exposed portions of said conductors overlie said exposed portions of said frets;

a layer of solder disposed between said exposed portions of said conductors and said exposed portions of said frets;

a cover connected to said base such that a lower surface of said cover overlies said upper surface of said base; and a pad connected with said lower surface of said cover, said pad overlying a surface of said cable opposite the exposed portions of said conductors, said pad being compressed between said cover and said base, said pad urging said exposed portions of said conductors and said exposed portions of said frets into abutting engagement with said layer of solder.

15. Apparatus comprising:

a base having an upper surface, said base including a plurality of electrically conductive frets having exposed portions on said upper surface of said base, said base including a passage on a lower surface of said base opposite said upper surface of said base, said passage exposing a surface of said frets opposite said exposed portions of said frets;

a cable that includes a plurality of spaced apart conductors surrounded by an insulating material, said conductors including exposed portions wherein said conductors are exposed through said insulating material, said cable being positioned on said base such that said exposed portions of said conductors overlie said exposed portions of said frets;

a layer of solder disposed between said exposed portions of said conductors and said exposed portions of said frets;

a cover connected to said base such that a lower surface of said cover overlies said upper surface of said base; and a pad connected with said lower surface of said cover, said pad overlying a surface of said cable opposite the exposed portions of said conductors, said pad being compressed between said cover and said base, said pad urging said exposed portions of said conductors and said exposed portions of said frets into abutting engagement with said layer of solder, said passage being adapted to receive means for applying heat to said exposed surfaces of said frets in order to melt and flow said layer of solder.

* * * * *